US009108202B2

(12) United States Patent
Stegelitz

(10) Patent No.: US 9,108,202 B2
(45) Date of Patent: Aug. 18, 2015

(54) HAMMER OF A BEATER MILL

(71) Applicant: ALSTOM Technology Ltd, Baden (CH)

(72) Inventor: Peter Stegelitz, Bratten (DE)

(73) Assignee: ALSTOM Technology Ltd, Baden (CH)

( * ) Notice: Subject to any disclaimer, the term of this patent is extended or adjusted under 35 U.S.C. 154(b) by 302 days.

(21) Appl. No.: 13/665,317

(22) Filed: Oct. 31, 2012

(65) Prior Publication Data

US 2013/0181079 A1 Jul. 18, 2013

(30) Foreign Application Priority Data

Oct. 31, 2011 (DE) ..... 10 2011 085 520

(51) Int. Cl.

| | |
|---|---|
| ***B02C 13/00*** | (2006.01) |
| ***B02C 13/28*** | (2006.01) |
| ***B02C 13/26*** | (2006.01) |
| ***B02C 13/04*** | (2006.01) |

(52) U.S. Cl.
CPC ..... *B02C 13/28* (2013.01); *B02C 13/04* (2013.01); *B02C 13/26* (2013.01)

(58) Field of Classification Search
CPC ..... B02C 13/28; B02C 13/00; B02C 13/26; B02C 13/2804; B02C 13/2812; B02C 2210/01; B02C 2210/02
USPC ..... 241/191–195, 294
See application file for complete search history.

(56) References Cited

U.S. PATENT DOCUMENTS

| | | | | |
|---|---|---|---|---|
| 3,236,463 | A * | 2/1966 | Ratkowski | 241/197 |
| 3,642,214 | A * | 2/1972 | Blackwell, Jr. | 241/191 |
| 3,829,032 | A * | 8/1974 | Schrimper | 241/197 |
| 5,285,974 | A * | 2/1994 | Cesarini | 241/194 |
| 5,381,976 | A * | 1/1995 | Chon et al. | 241/197 |
| 6,045,072 | A * | 4/2000 | Zehr | 241/189.1 |
| 6,089,480 | A * | 7/2000 | Rawlings | 241/73 |
| 6,422,495 | B1 * | 7/2002 | De Boef et al. | 241/197 |
| 6,517,020 | B1 * | 2/2003 | Smith | 241/294 |
| 6,840,471 | B2 * | 1/2005 | Roozeboom et al. | 241/197 |
| 7,055,770 | B2 * | 6/2006 | Bardos | 241/189.1 |
| 7,281,676 | B1 * | 10/2007 | Bennington | 241/294 |
| 7,384,011 | B1 * | 6/2008 | Smith | 241/55 |
| 7,726,594 | B2 * | 6/2010 | Smith | 241/55 |
| 2009/0250538 | A1 | 10/2009 | Schmitz et al. | |

FOREIGN PATENT DOCUMENTS

| | | |
|---|---|---|
| CN | 201744379 | 2/2011 |
| DE | 42 15 666 | 10/1993 |
| DE | 29521489 U1 | 7/1997 |
| DE | 20120185 | 3/2002 |
| DE | 20120185 U1 | 3/2002 |

(Continued)

*Primary Examiner* — Faye Francis

(57) ABSTRACT

A hammer (5) for a beater mill used to process coal, biomass material and other materials is provided having a hammer body (11), an impeller head (13) at a first end of the hammer body (11), and a bore (15) at a second opposite end of the hammer body (11). The impeller head (13) is detachably connected to the hammer body (11) by a base plate 17. Base plate (17) has a first side with a protrusion (21) and at least one bolt (29) protruding therefrom and a second opposed planar side with a crushing member (19). Protrusion (21) and at least one bolt (29) detachably connects impeller head (13) to first end of hammer body (11).

18 Claims, 8 Drawing Sheets

(56) References Cited

FOREIGN PATENT DOCUMENTS

| | | |
|---|---|---|
| JP | 09-271684 | 10/1997 |
| SU | 704659 | 12/1979 |
| SU | 704660 | 12/1979 |
| SU | 929217 | 5/1982 |
| SU | 946653 | 7/1982 |
| SU | 1417921 | 8/1988 |
| WO | 97/05951 | 2/1997 |
| WO | 02/055203 | 7/2002 |
| WO | 2006/122874 | 11/2006 |
| WO | 2007002440 A2 | 3/2007 |

* cited by examiner

HAMMER OF A BEATER MILL

BRIEF DESCRIPTION

Beater mills comprising a rotor and several hammers are often used to process coal, biomass material and other materials.

Examples for this type of beater mills are for example known from EP 2 359 934 A2 or EP 1 028 808 B1.

Beater mills comprise a rotor and a casing. Several hammers are bolted to the rotor. During operation, the rotor drives the hammer, which crushes, for example, coal to reduce its grain size. Since coal is rather abrasive, the head of the hammer that changes this form and size due to abrasion leading to an increasing specific power demand.

Once the hammers have reached a certain abrasion they need to be changed. For this reason the hammers are bolted to the rotor by means of a bolt and a nut for example.

To extend the time intervals before changing the hammers, it is known to cast or forge the hammers of a material with a great resistance against abrasion. These materials are rather expensive and difficult to machine. A second solution to extend the time intervals between the replacement of the hammers due to abrasion consists of a compound casting. This means that a hammer made of a material that is very resistant against abrasion is cast into the hammer body of, for example, mild steel or cast iron.

It is an object of the invention to improve these solutions with regard to extending the time between replacement intervals and/or reducing the costs for replacing worn hammers.

To achieve these objectives, a hammer of a beater mill is suggested that comprises a hammer body, an impeller head at a first end of the hammer body and fixing means on the opposite end of the hammer body, and is characterized in that the impeller head is detachably connected to the hammer body.

Since the hammer of the claimed invention is made of two parts—e.g., the hammer body and the impeller head—several advantages are achieved:

First of all, it is possible to optimize the design of the impeller head and the material of the impeller head independently from the design of the hammer body and the material the hammer body is made of.

On the other hand it is possible to easily disconnect the impeller head from the hammer body, once the impeller head is worn. Since the hammer body undergoes only slight abrasion, the hammer body can remain inside the beater mill for a very long time and multiple impeller heads can be subsequently connected, one after the other, to the hammer body, once the present impeller head is worn. This means that the costs for replacing hammer bodies is significantly reduced.

The replacement of an impeller head only requires a very short time, since only one or two screws need to be loosened, a new impeller head can then be put onto the hammer body and the one or two screws are tightened again. This replacement of an impeller head takes only few minutes and it does not require the hammer body to be dismantled from the rotor of the beater mill.

Of course, in case of dismantling of the hammer body from the rotor is less time consuming than the replacement of an impeller head inside the beater mill, it is also possible to dismantle to replace the impeller head outside the beater mill and to change the hammers completely if they are worn out and subsequently make a retrofit of the replaced hammers outside the beater mill. In this case the stand still times of the beater mill is minimized.

A very simple method of detachably connecting the impeller head to the hammer body includes a screw connection.

To further support the transfer of the centrifugal forces applied to the impeller head to the hammer body during operation of the beater mill, the impeller head is positively locked with the hammer body. This can be achieved for example if the impeller head comprises protruding means and that the hammer body comprises a complementary recess and/or perforation. This type of positively locked connection between the hammer body and the impeller head reduces the dynamic stress to the bolts and screws and assures that the impeller head is positioned correctly relatively to the hammer body. Consequently, the replacement of the impeller head can be done not only by a skilled worker, but also by workers that are not that highly qualified.

To further optimize the abilities of the impeller head it is claimed that the impeller head comprises a base plate and a crushing member. The base plate may include bolts or threads that allow the base plate to be screwed to the hammer body. This means that the base plate may be made of mild steel, cast iron or forged steel. This further means that producing such a base plate is not very costly.

The crushing member of the impeller head that has intensive contact with the coal or the other material to be crushed, may be made of an extremely abrasive material, even if this material is expensive, since only the parts of the impeller head that have intensive contact with the coal have to be made of this material and only a relatively small amount of this material is needed.

A further advantage of the claimed split design is the fact that the crushing member has no other functions than crushing the coal or any other material and consequently can be designed and optimized with regard to the material and form focused on this function.

The base plate and the impeller head may be soldered, welded or cast together.

Further advantages of the claimed inventions are shown in the drawings and their descriptions.

DESCRIPTION OF THE EMBODIMENTS

Figure 1:
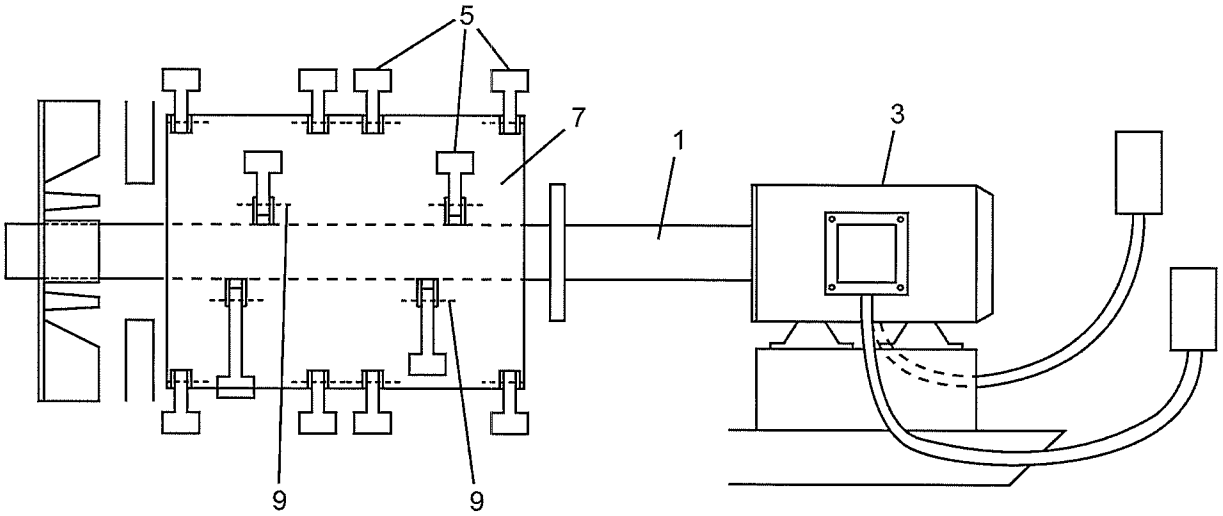
FIG. 1 shows a rotor of a beater mill equipped with several hammers according to the claimed invention.

FIG. 1 illustrates a rotor 1 that is driven by an electric drive 3 and equipped with several hammers 5. For reasons of clarity not all hammers have the reference number 5.

The hammers 5 are bolted to a drum 7 of the rotor 1 by means of a bolt and nut. This bolt and nut connection between the drum 7 of the rotor 1 and the hammer 5 is state of the art and therefore is not shown in detail. An interrupted line 9 serves a schematic illustration of the bolt and nut connection between hammer 5 and drum 7. The claimed invention is related to the design of the hammers 5 and consequently FIGS. 2A-2C and 3A-3D illustrate two embodiments of the claimed hammer in several views.

Figure 2A:
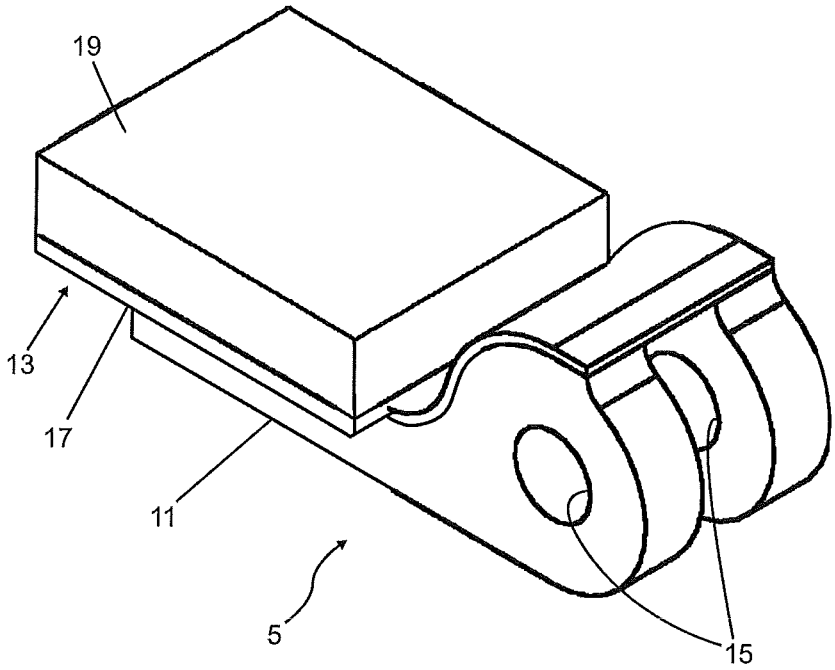
FIGS. 2A and 2B show perspective views of the claimed hammer according to a first embodiment of the claimed invention.
Figure 2B:
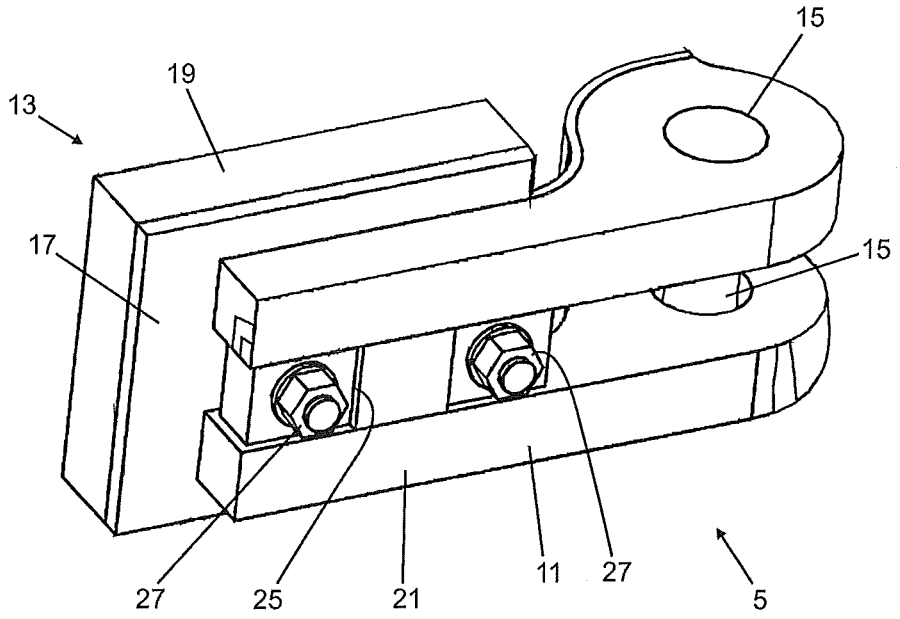

FIGS. 2A and 2B show perspective views of the claimed hammer according to a first embodiment of the invention.

Figure 2C:
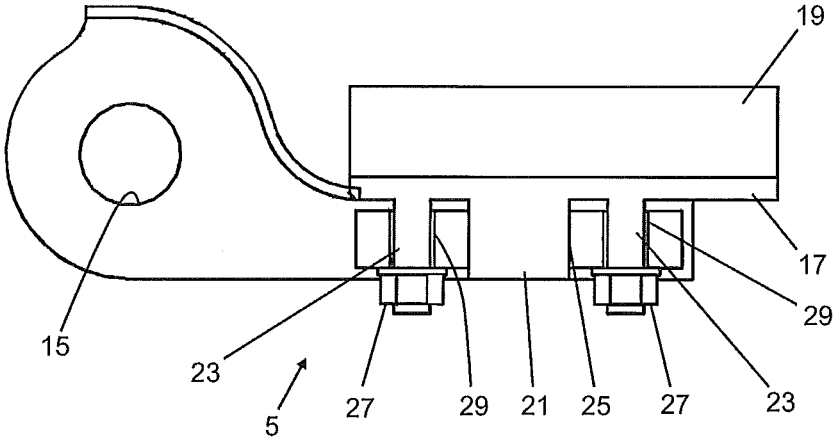
FIG. 2C shows a longitudinal section of the first embodiment of the claimed hammer.

FIG. 2C shows a longitudinal section of the first embodiment of the claimed hammer 5.

As can best be seen from FIG. 2B the hammer 5 comprises a hammer body 11. At a first end of this hammer body 11 an impeller head 13 is mounted. At the opposite end of the hammer body 11 a bore 15 or perforation is comprised. The bore 15 is the fixing means to connect the hammer 5 with the drum 7 of the rotor 1 as can be seen from FIG. 1.

As can be seen from the FIG. 2B the impeller head 13 comprises a base plate 17 and a crushing member 19. The crushing member 19 may be made of ceramics. In any case it has to be made of a material that is highly resistant against abrasive wear. The abrasion of the crushing member 19 depends on the material to be crushed. Due to the interaction between the material to be crushed and the material of the crushing means the decision for a material for the crushing means depends on the material to be crushed.

In many cases ceramic materials are well suited for the crushing member 19. The crushing member 19 of the first embodiment has as illustrated a rectangular or quadratic base area and is connected along this base area to the base plate 17. Other designs of the base areas are also included in the claimed invention.

The base plate 17 may be made of steel, for example mild steel and can be manufactured by milling for example.

The base plate 17 and the crushing member 19 may be connected with each other for example by soldering, welding, gluing or any other suitable method.

From the back side of the base plate 17 a protrusion 21 and two bolts 29 protrude (FIG. 2C). The protrusion 21 has a square cross section.

The hammer body 11 comprises a complementary formed perforation 25 so that a positively locked connection between the hammer body 11 and the impeller head 13 is active, once the impeller head 13 is installed and fixed with nuts 27 that engage with the bolts 23 of the base plate 17. This means that the centrifugal forces of the impeller head are transferred to the hammer body 11 mainly by means of the protrusion 21 and the perforation 25 of the hammer body 11. The bolts 23 and the nuts 27 serve more or less to fix the impeller head 13 to the hammer body 11.

Of course, it would be possible, to make the bolts 23 and the corresponding bores 29 in the hammer body 11 larger in diameter so that they constitute the positive locking between impeller head 13 and hammer body 11. The bores 29 in the hammer body 11 can best be seen in FIG. 2C.

Due to the positively locked impeller head 13 it is very easy even for unskilled persons to replace the impeller heads 13 once they are worn. To replace a worn impeller head 13 it is only necessary to loosen the nuts 27. If the nuts 27 are dismantled it is possible to pull the protrusion 21 and the bolts 23 of the impeller head 13 out of the corresponding perforation 25 and bores 29 of the hammer body 11 and to fit a new impeller head 13 onto the hammer body 11.

This design is rather simple as far as the manufacturing of the hammer body 11 and the impeller head 13 are concerned. The impeller head 13 can be manufactured in great numbers and replaced if necessary.

Since the connection between the hammer 5 according to the claimed invention and the rotor 1 in a state of the art beater mill is not effected by the claimed invention, the claimed invention is very well suited as a retrofit solution for already existing beater mills. Of course, the dimensions of the impeller head 13 and the hammer body 11 have to be adapted to the dimensions by design of the beater mill if it used as a retrofit solution.

In FIGS. 3A-3D a second embodiment of the claimed invention is shown.

The same parts have the same reference numerals as in FIGS. 2A-2C. The main difference between the first and the second embodiments concerns the positively locking of the impeller head 13 and the hammer body 11. As can best be seen from FIG. 3C the base plate 17 comprises a protrusion 21 and one bolt 23.

Figure 3A:
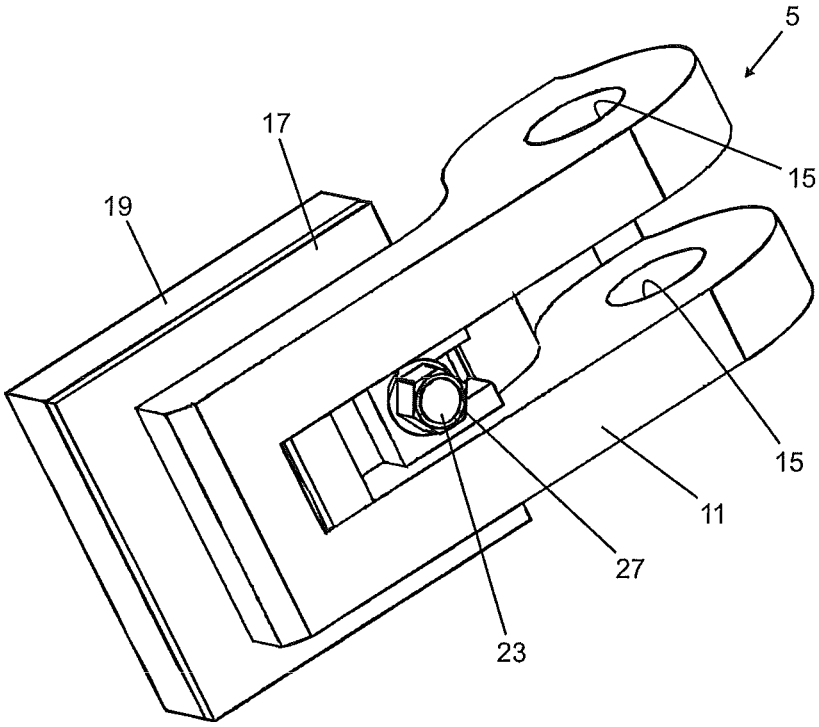
FIG. 3A shows bottom perspective view of a second embodiment of the claimed invention.
Figure 3B:
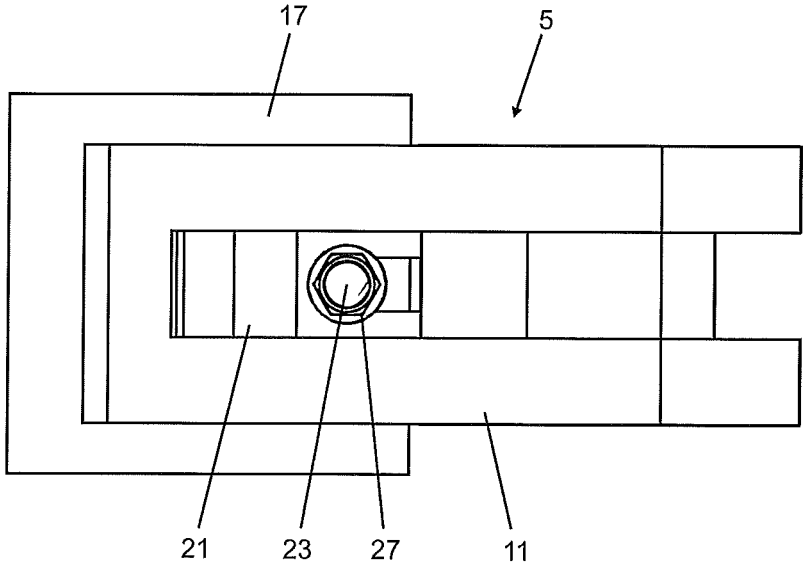
FIG. 3B shows a bottom plan view of the second embodiment of the claimed invention.
Figure 3C:
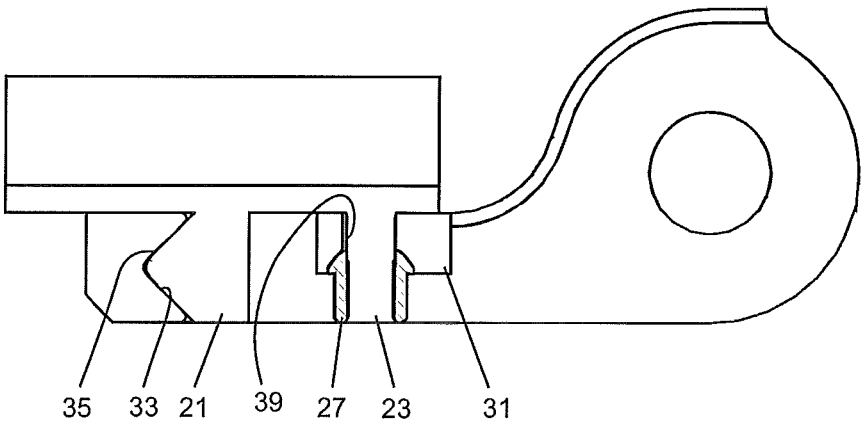
FIG. 3C shows a longitudinal secion of the second embodiment of the claimed invention.
Figure 3D:
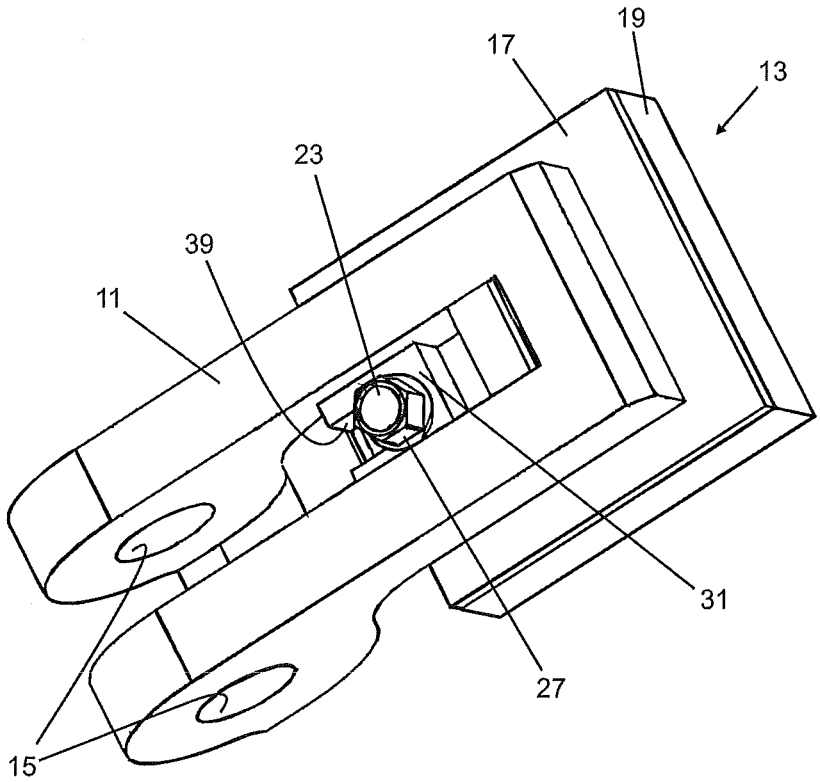
FIG. 3D shows another bottom perspective view of the second embodiment of the claimed invention.

The protrusion 21 has on the left side on FIG. 3C a triangular key 33. At the first end of the hammer body 11 a slot 35 with a complementary cross section is comprised. This key and slot connection 33 and 35 very effectively transfers the centrifugal forces between the impeller head 13 and the hammer body 11 and centers the impeller head 13 using the centrifugal forces.

To make sure that the key and slot connection 33 and 35 remain engaged during operation of the beater mill, the hammer body 11 comprises a second protrusion 31 with a slot 39 for the bolt 23.

The slot 39 is chamfered at one end and interacts with a cone shaped end of the nut 27 for further fixing the impeller head 13 to the body 11. The slot can best be seen from FIG. 3D).

The invention claimed is:

1. A hammer of a beater mill comprising:

a hammer body;

an impeller head comprising a base plate having a first side with a protrusion and at least one protruding bolt and a second planar side opposite the first side with a crushing member operable for processing coal or biomaterial, detachably connected by the at least one protruding bolt to a first end of the hammer body with a surface of the protrusion exposed when so detachably connected; and fixing means on the opposite end of the hammer body for detachably connecting the hammer body to a rotor drum.

2. The hammer according to claim 1, wherein the impeller head is connected with the hammer body through a key of the impeller head protrusion arranged within a complementary slot of the hammer body.

3. The hammer according to claim 1, wherein a perforation through the hammer body accommodates the protrusion of the impeller head.

4. The hammer according to claim 1, wherein the protrusion of the impeller head comprises a key and wherein a perforation in the hammer body comprises a complementary slot.

5. The hammer according to claim 1, wherein the hammer body fixing means comprises a protrusion with a slot for a bolt.

6. The hammer according to claim 1, wherein the impeller head comprises a cast base plate and crushing member.

7. The hammer according to claim 1, wherein the base plate is made of steel or cast steel.

8. The hammer according to claim 1, wherein the crushing member comprises ceramics, ceramic inlays in white iron, hard faced material, composite cast steel, or a monometallic solution.

9. The hammer according to claim 1, wherein the crushing member and the base plate are welded together, soldered together, sintered together or cast together.

10. The hammer according to claim 1, wherein the hammer body is made of steel or cast steel.

11. The hammer according to claim 1, wherein the impeller head is releaseably attached to the hammer head.

12. A beater mill including a rotor and a plurality of hammers coupled to a drum of the rotor, each hammer comprising:

a hammer body;

an impeller head comprising a base plate having a first side with a protrusion and at least one protruding bolt and a second planar side opposite the first side with a crushing member, detachably connected by the at least one protruding bolt at a first end of the hammer body with a surface of the protrusion exposed when so detachably connected; and fixing means on the opposite end of the hammer body for detachable attachment of the hammer body to the drum operable to process coal or biomaterial.

13. The beater mill according to claim 12, wherein the impeller head is connected with the hammer body through a key of the impeller head protrusion arranged within a complementary slot of the hammer body.

14. The beater mill according to claim 12, wherein the protrusion of the impeller head is accommodated within a complimentary perforation through the hammer body.

15. The beater mill according to claim 12, wherein the protrusion of the impeller head comprises a key and a perforation through the hammer body comprises a complementary slot for accommodating the key.

16. The beater mill according to claim 12, wherein the fixing means of the hammer body comprises a protrusion with a slot for a bolt.

17. The beater mill according to claim 12, wherein the impeller head comprises a cast base plate and crushing member.

18. The beater according to claim 12, wherein the impeller head is releaseably attached to the hammer body.

* * * * *